United States Patent [19]

Dickinson

[11] Patent Number: 4,715,742

[45] Date of Patent: Dec. 29, 1987

[54] MANUALLY DEPRESSIBLE AUTOMATICALLY DEPLOYABLE SPRING BALANCED BOLLARD

[76] Inventor: Harry D. Dickinson, 1681 Larco Way, Glendale, Calif. 91302

[21] Appl. No.: 840,389

[22] Filed: Mar. 17, 1986

[51] Int. Cl.[4] ..... E01F 13/00

[52] U.S. Cl. ..... 404/6; 49/49

[58] Field of Search ..... 404/6, 11; 49/49; 52/113, 727

[56] References Cited

U.S. PATENT DOCUMENTS

| | | | |
|---|---|---|---|
| 3,086,430 | 4/1963 | Emmel | 404/6 |
| 3,462,023 | 8/1969 | Grove | 212/268 |
| 3,660,935 | 5/1972 | Boots | 49/35 |
| 3,698,135 | 10/1972 | Boots et al. | 49/49 X |
| 4,003,161 | 1/1977 | Collins | 49/49 X |
| 4,320,380 | 3/1982 | Berard et al. | 49/49 X |
| 4,490,068 | 12/1984 | Dickinson | 404/6 |
| 4,576,508 | 3/1986 | Dickinson | 404/11 X |
| 4,577,991 | 3/1986 | Rolow | 49/49 X |

FOREIGN PATENT DOCUMENTS

| | | | |
|---|---|---|---|
| 15319 | of 1887 | United Kingdom | 52/727 |

*Primary Examiner*—Carl D. Friedman

*Attorney, Agent, or Firm*—William H. Maxwell

[57] ABSTRACT

A bollard type trafficway barrier for arresting vehicles, comprised of a cast in place foundation and a bollard replaceable therein with a spring for lifting the bollard that is directionally oriented with respect to traffic so as to withstand great impacts, and with access for replacement of the bollard, with retraction by manual depression and extension by instantaneous release of potential energy stored in said spring, the bollard being locked in both the retracted and extended conditions, and installation being flush with the grade when retracted and the bollard being released manually or power controlled from a remote location by a vehicle sensor.

18 Claims, 12 Drawing Figures

MANUALLY DEPRESSIBLE AUTOMATICALLY DEPLOYABLE SPRING BALANCED BOLLARD

Reference is made to copending application Ser. No. 679,079 filed Dec. 6, 1984, entitled BOLLARD TRAFFICWAY BARRIER AND VEHICLE ARREST SYSTEM, issued Mar. 18, 1986 as U.S. Pat. No. 4,576,508.

BACKGROUND

This invention relates to anti terrorist barricades capable of stopping the movement of vehicles unauthorized to enter a trafficway. A vehicle moving toward such a barricade has a certain kinetic energy which is a measure of the hitting power it possesses. This kinetic energy is calculated from the vehicle weight and velocity, and on impact with such a barrier the kinetic energy is then converted into heat, sound and deformation of the vehicle, and in some cases deformation of the barrier, in this case the "bollard". In actual practice, the total energy dissipation depends upon varying factors prevailing at the moment of impact, all of which need not be detailed here. However for example, a vehicle moving at 50 mph has twenty times as much kinetic energy as it would moving at 10 mph; or for example an armored car weighing thirty times as much as a small passenger car and moving at 10 mph would have less kinetic energy than said passenger car moving at 60 mph. It is within this approximate range of kinetic energy with which this invention is primarily concerned, it being a general object of this invention to provide a retractile bollard that is configured to provide maximum protection against vehicle assault within a minimum package or installation area. Multiple bollards are to be used to barracade a trafficway.

In accordance with this invention, the bollard is a structural steel fabrication that is instantaneously lifted into working position by a directly coupled spring means, so that it can be extended as a barrier to traffic. The bollard and spring means is depressed during the interim time awaiting release for extension. The geometry of the bollard is disposed and rotatably oriented so that the energy of impact is efficiently transmitted into a rugged foundation that absorbs said energy, within its elastic limit that exceeds the rupture point of the bollard under the same impact conditions. Accordingly, under major impact conditions the bollard per se may be damaged or destroyed and it is therefore considered to be expendable and adapted to be readily replaced. It is an object of this invention, therefore, to provide a barrier of unit construction wherein the bollard is individually replaceable.

The retractile bollard of the present invention is characterized by the aforesaid foundation and by a direct installation of the bollard in said foundation. A feature is the flush trafficway condition of this barrier unit, when the bollard is retracted, and to this end access means as disclosed herein provides for disassembly and repair, service and replacement of the bollard per se. It is an object of this invention to provide for this accessability and replaceability.

The bollard is operated by a yieldable lift means, preferably by potential energy stored in a spring system as herein described. However, the term "lift means" or "spring" is to include such means as metal springs, elastic springs, pneumatic springs and hydraulic springs, and any other such resilient means or the like. In practice, operation is from a resilient metal coil spring, preferably a compression spring, as will be described. A feature of this barrier system is its capability of released by either manual or automatic remote operation, as circumstances require.

The typical collision point above grade is presumed to be approximately 17 inches, the average height of a vehicle bumper. Accordingly, the bollard is extended well above the point of collision, for example to a height of about two or three feet, all of which may vary as required. The actuation of the bollard between the vertically extended and the retracted position is manual through the application of a person's body weight for the storage of potential energy in the spring, it being an object to eliminate the necessity of power means heretofore required to raise such bollards. With the preferred form of bollard motivation, for extension, a manually depressible compression spring is employed, wherein potential energy is stored and available for subsequent instantaneous action. As disclosed herein, there is a latch that is manually controlled or automatically controlled as may be required. Lifting of the bollard is by the relase of potential energy stored in a spring and released as kinetic energy for instantaneous raising of the bollard.

A feature of this barrier unit installation is that it is self bailing and rids itself of the accumulation of surface waters. By cycling the bollard downwardly, most of the surface water entering into the foundation cavity can be pumped out.

Upon severe impact of a vehicle against a bollard type barrier, there is a tendancy for parts of the vehicle to move vertically as a result of forces imposed by the inertia of other collapsing vehicle parts. Upward vertical movement is to be avoided, it being an object of this invention to capture the vehicle against upward movement upon impact with the bollard. In practice, a lip is provided at the top of the bollard, and the lip being flush with the grade level when the bollard is retracted, and the lip being exposed to impacted vehicle parts when the bollard is extended.

Captured tamper-proof assembly of the bollard within the foundation therefor is essential, it being an object of this invention to provide retractile bolts in the foundation for working engagement with stops on the bollard, while limiting extension of the bollard with the guides means thereof engaged in the foundation.

SUMMARY OF THE INVENTION

The bollard type barricade disclosed herein is a spring balanced and elevated barrier that is retractable below grade within a cast in place foundation, preferably a steel cylinder that provides a pit. The bollard per se drops into the foundation cylinder with first guide means to rotatably orient the bollard for impact strength. And the bollard per se is then received by the foundation cylinder and centered therein over the lifting spring by a second guide means that ensures coaxial alignment of the bollard and foundation cylinder. A feature is a third guide means that ensures alignment of the lift spring for its reliable operation upon release. It is the manually applied spring compression and the storage of potential energy that is subsequently released as kinetic energy to raise the bollard instantaneously. Alternately, the bollard can balance upon the spring. However, advantage can be gained in the preferred use by utilizing the inertia of the upwardly accelerated bollard, which carries it to an elevated position where it is latched.

The foregoing and various other objects and features of this invention will be apparent and fully understood from the following detailed description of the typical preferred form and application thereof, throughout which description reference is made to the accompanying drawings.

DESCRIPTION OF THE DRAWINGS

FIG. 7 is an enlarged detailed sectional view taken as indicated by line 7—7 on FIG. 3.

Figure 8:
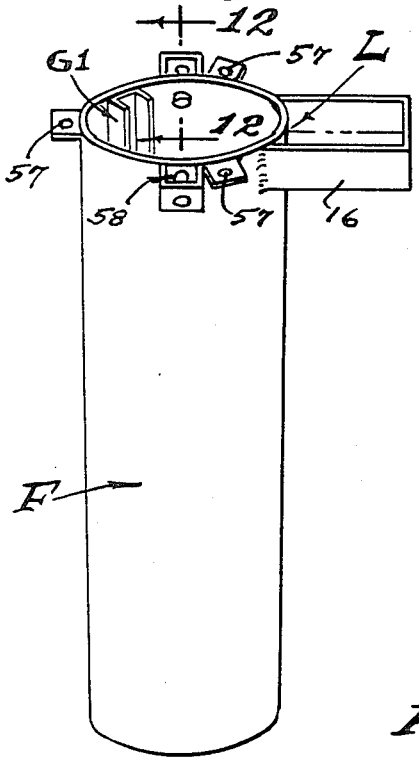
FIGS. 8, 9 and 10 are perspective views of the three principal structural components that make up this barrier installation.
Figure 12:
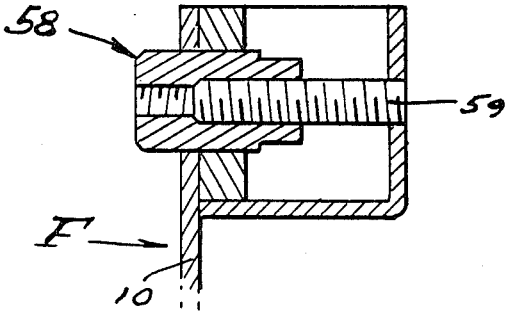

And, FIG. 12 is an enlarged fragmentary sectional view of retainer means taken as indicated by line 12—12 on FIG. 8.

PREFERRED EMBODIMENT

Figure 1:
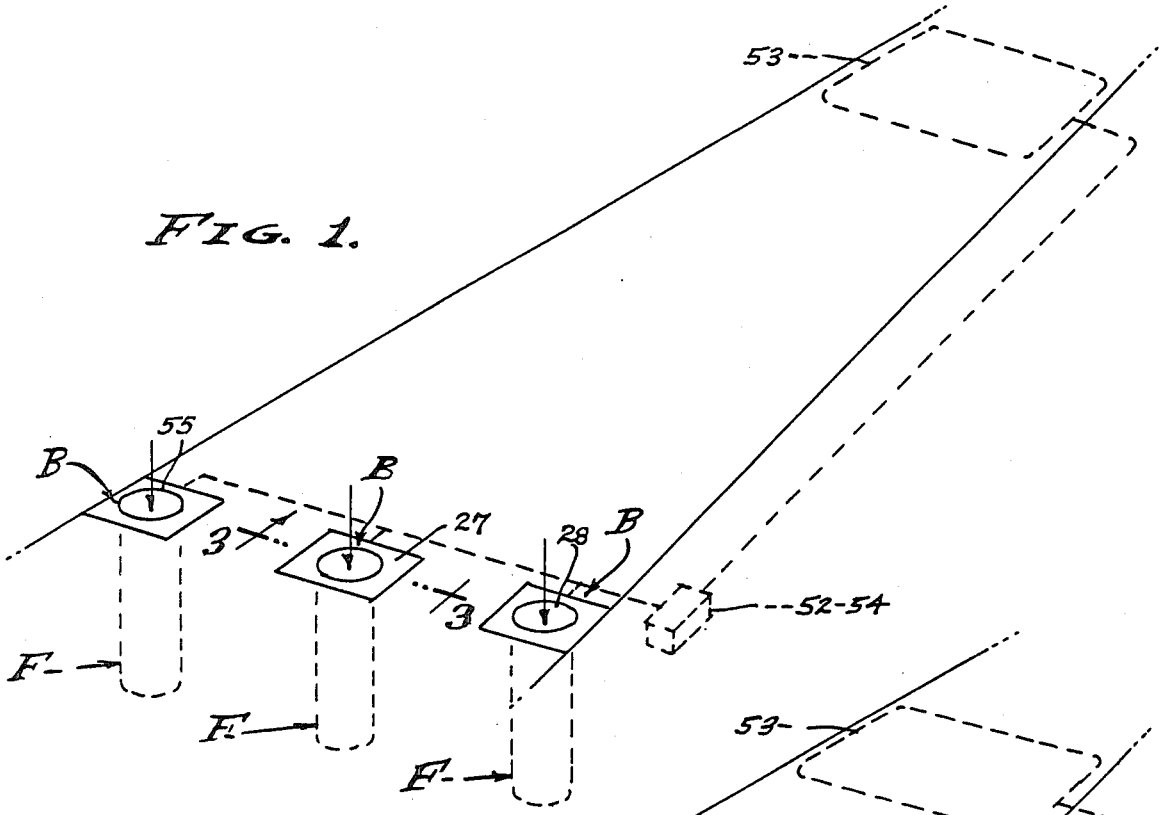
FIGS. 1 and 2 are perspective views of the trafficway barrier installation, FIG. 1 showing the bollard retracted, and FIG. 2 showing the bollard extended.
Figure 2:
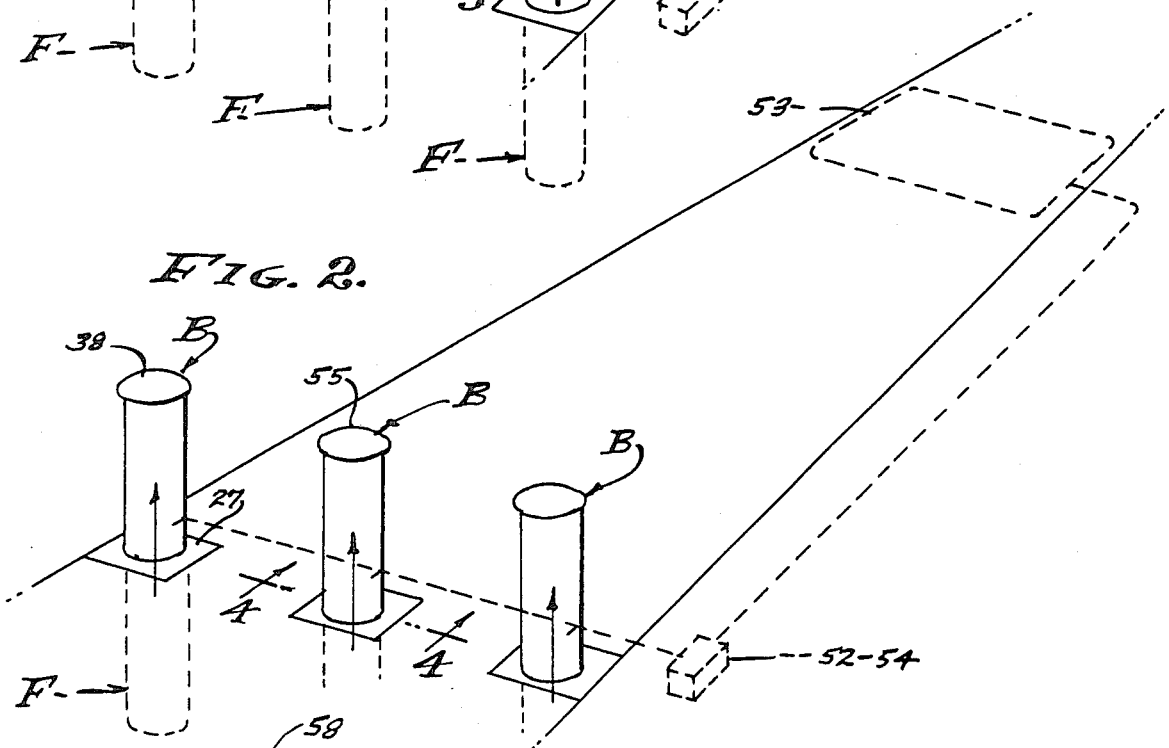
Figure 5:
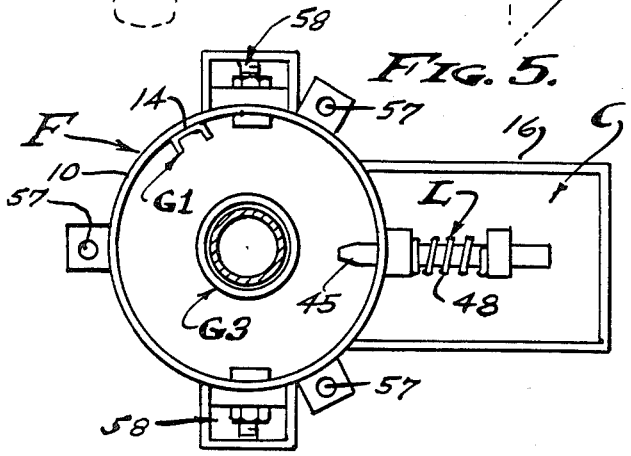
FIGS. 5 and 6 are enlarged detailed sectional views, FIG. 5 being a detail of the foundation taken as indicated by line 5—5 on FIG. 4, and FIG. 6 being a detail of the bollard taken as indicated by line 6—6 on FIG. 4.

Referring now to the drawings, FIG. 1 shows the retracted condition of a multiplicity of bollards B placed in a trafficway for the obstruction of traffic movement in either direction. Note that all features of the installation of this barrier unit are at or below grade level. In FIG. 2 is shown the elevated or raised or extended condition of the bollards B, each extending to a height well above the grade level or trafficway surface. In practice, depression of the bollards B is individually applied thereto, while elevation thereof is simultaneous and occurs during a time span of a fraction of a second, as may be required and according to the spring source made available.

Figure 3:
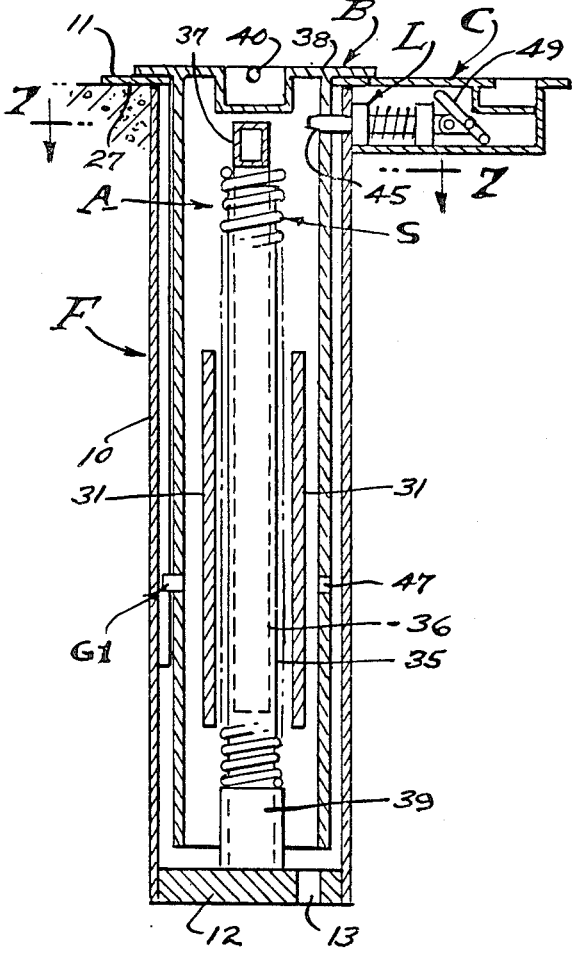
FIG. 3 is an enlarged sectional view taken as indicated by line 3—3 on FIG. 1.
Figure 4:
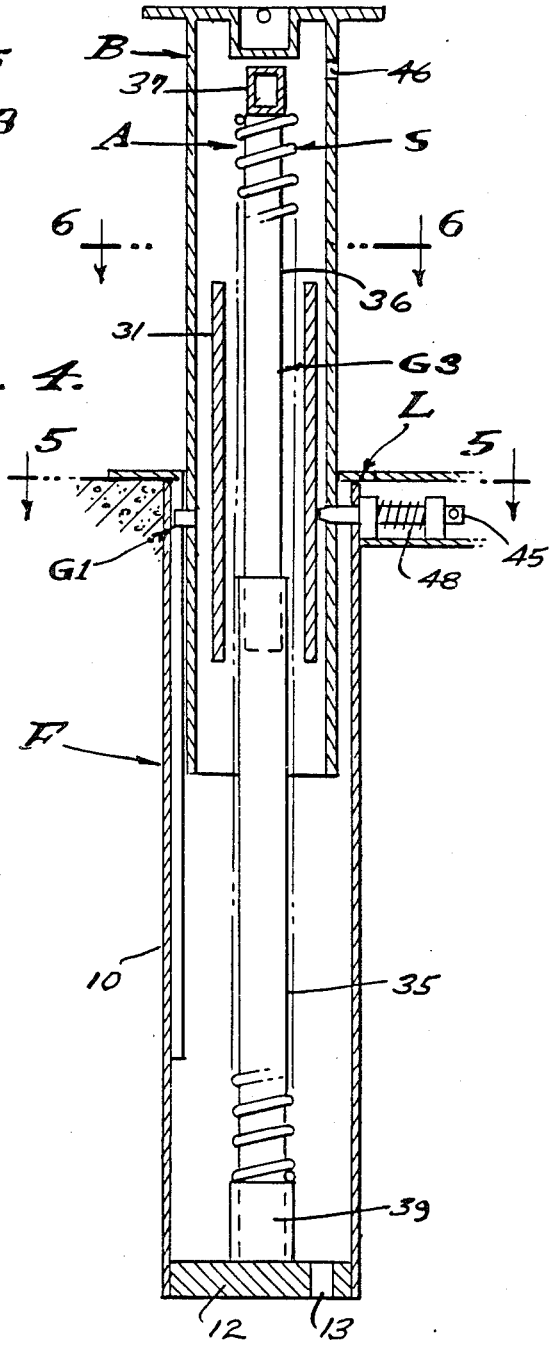
FIG. 4 is an enlarged sectional view taken as indicated by line 4—4 on FIG. 2.
Figure 9:
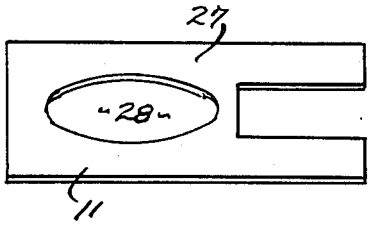
Figure 10:
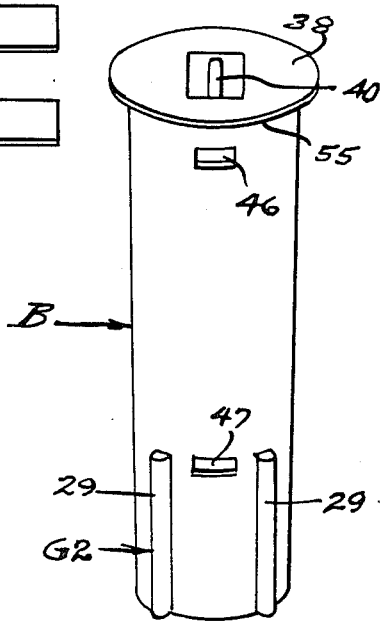

As shown in FIGS. 8, 9 and 10 of the drawings, each barrier unit as shown in FIGS. 1 and 2 is comprised generally of a foundation F, the bollard B, and a latch means L to secure the bollard in either a retracted position or an extended position. As shown in FIGS. 3 and 4, a spring lift means A operates the bollard. The foundation F is permanently installed below grade level, as by casting it in place in concrete as clearly shown in FIGS. 3 and 4. The foundation F is of tube form, and preferably of cylinder cross section disposed on a central vertical axis along which the bollard B is extended and retracted. The foundation F has a peripheral wall 10 open at the grade level with mounting flanges 11 flush with the grade, and closed at its lower end by a bottom 12 through which there is a drain 13.

A first guide means G1 extends vertically at the interior of the wall 10 to guide and rotatably orient the bollard B, a second guide means G2 extends vertically at the exterior of the bollard B to guide it coaxially within the foundation F, and a third guide means G3 extends centrally within the spring S of the lift means A to prevent the spring from collapsing.

The guide means G1 is comprised of a vertically disposed channel 14 coextensive within the height of the foundation wall 10 and a follower 15 operable along the channel. As shown, the channel 14 is fixed to the inner diameter wall of the foundation tube, and the follower 15 projects from the outer diameter wall of the bollard B. A control box 16 is provided at the outer side of the foundation tube wall for accomodating control means C later described.

The bollard B is a reinforced tube structure, and preferably of cylinder cross section coaxially disposed within the confines of the foundation F when retracted as shown in FIG. 3. When the bollard is extended it projects along the vertical axis as shown in FIG. 4. As best illustrated in FIG. 7 there is an annulus between the concentric foundation F and the bollard B, to accomodate the guide means G1 and G2. A deck plate 27 with a clearance opening 28 therethrough passes the bollard and closes the annulus. The deck plate is welded to and integral with the foundation tube, as shown.

Guide means G2 is comprised of circumferentially spaced runners 29 that project from and extend along the lower portion of the bollard exterior wall 30. The guide runners 29 are parallel with the axis of the unit, and they have sliding clearance and/or engagement within the inner diameter of the foundation wall 10. As shown, there are four runners 29 in two pairs and each pair thereof being aligned with the structural webs (31) of the reinforced bollard, next to be described. It is significant that the runners 29 transfer the load of the webs directly into the foundation F and into the cast concrete into which the bollard unit is set. This runner engagement within the confines of the cylinder wall 10 of the foundation F maintains the coaxial vertical disposition of the bollard B within the foundation tube through vertical movement and when subjected to vehicle impact forces.

Figure 6:
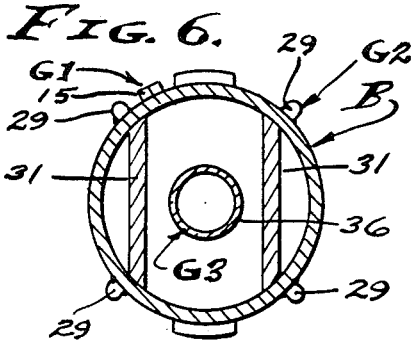
Figure 2:
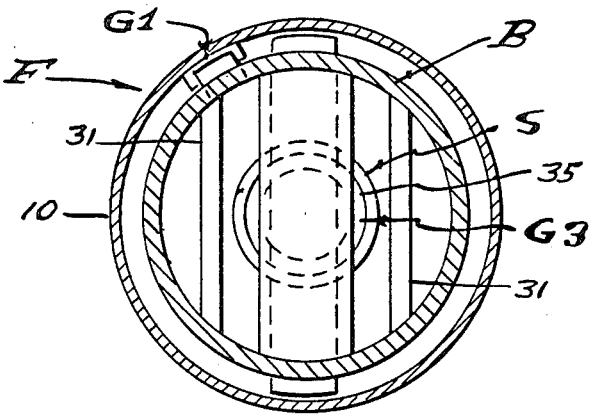

In accordance with this invention, the bollard B is a structurally reinforced member adapted to resist impact in the direction of trafficway movement of vehicles to be stopped. Accordingly, the interior of the bollard B is provided with reinforcement means disposed to efficiently strengthen the bollard in alignment with the direction of trafficway movement. For example, a square tube with its corners coextensively engaged with and/or welded to the inner wall of the bollard greatly resists collapse thereof, or disc-shaped transverse bulkheads at frequent intervals therein resist collapse. As shown, at least one end preferably a pair of planar webs 31 are disposed vertically and coextensively of the bollard cylinder between opposite front and back interior wall surfaces thereof and in planes parallel to the direction of trafficway vehicle movement. As shown in FIGS. 6, and 7, the webs are substantial and coextensively integral with the bollard wall 30 to form a box section characterized by the planar walls 31 that provide great strength in the direction of vehicle impact. A feature is the alignment of a pair of runners 29 with each of said webs 31, the runners 29 being in the form of rails on the periphery of the bollard B and extending upwardly from the bottom of the bollard approximately two fifths or 40% of the total height thereof, as shown. Essentially, the runners 29 are disposed in the planes of the webs 31, or substantially so.

Guide means G3 is comprised of telescoping members disposed coaxially within the bollard B, a tube member 35 projecting upwardly from the bottom 12 of the foundation F and a tube member 36 depending from the top of the bollard B. The tube members 35 and 36 pass through and between the reinforcing webs 31 and coaxially within the bollard B and its surrounding cylindrical foundation F. The tube member 36 is affixed to the bollard B by means of a header 37 extending diametrically within the bollard wall 30 and beneath the top 38 of the bollard. In practice, the header 37 is of tube form that provides a spring seat surrounding the tube member 36. The members 35 and 36 remain telescopically engaged at all times, including the fully extended and raised condition of the bollard, as shown in FIG. 4.

The spring lift means A is provided to balance the bollard B in a partially raised condition (not shown) where its weight is in equilibrium with the spring forces that support it. In the preferred form of this invention, the spring means A is a simple coil spring S used in compression between the spring seat of the header 37 and a spring seat 39 at the bottom 12 of the foundation F. The seat 39 is of tube form slideably engaged over the tube member 35 to adjustably (by dimension) support the spring S. Since the bollard B is inherently balanced in a partially raised condition, a recessed handle 40 is provided in the top 38 of the bollard, so that it can be lifted manually to a fully raised position. An operational feature is that the bollard B can be depressed against the spring S, and then pulled upwardly to advantageously utilize the assist and accellerating force of the spring applied as kinetic energy to the bollard. As a result, the bollard is assisted by the spring to be raised above the normal balanced condition. In practice, the bollard B is raised from the latched position shown in FIG. 3 to the latched position shown in FIG. 4, entirely by the potential energy stored in spring S, which is converted to kinetic energy in the bollard.

In accordance with this invention, the latch means L is provided to lock the bollard B in both the retracted and the extended position as shown in FIGS. 3 and 4. When manually lifting the bollard B from the aforementioned balanced condition thereof, the extended position of FIG. 4 is to be locked. When potential energy of spring S is utilized to lift the bollard B from the retracted condition of FIG. 3 to the extended condition of FIG. 4 the said FIG. 3 condition is firstly unlocked and then the FIG. 4 condition is locked. As shown, the control box 16 houses a releasable bolt 45 engageable with stops on the wall 30 of the bollard B. In practice, the stops are openings in the bollard wall to receive the bolt, there being an upper opening 46 to secure the retracted condition of FIG. 3, and there being a lower opening 47 to secure the extended condition of FIG. 4. The bolt 45 is biased by a spring 48 to automatically enter either opening 46 or 47, after its release to clear or to slide upon the surface of the bollard B.

Figure 11:
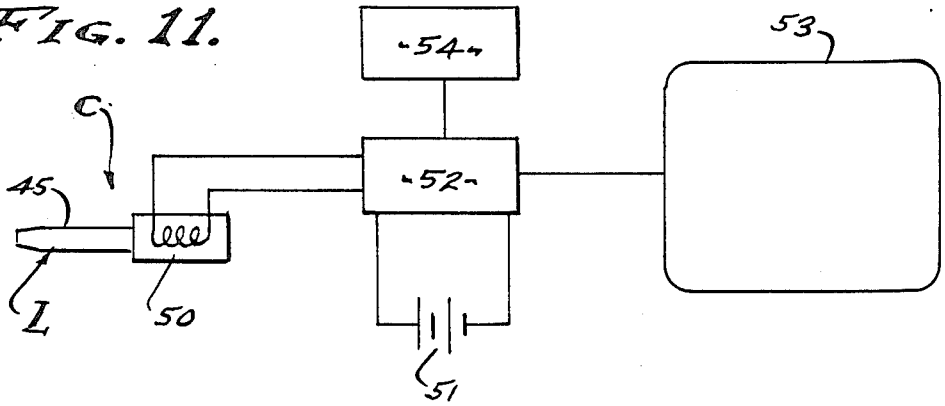
FIG. 11 is a schematic diagram of the electronic control system for instantaneous operation of the barricade.

The bolt 45 is either manually operable as shown in FIGS. 3 and 4, directly or remotely, or it is power operated as shown in FIG. 11. The control box 16 is recessed below grade level and has a removeable cover for manual access to a lever 49 by which the bolt 45 can be retracted from either opening 46 or 47. Replacement of the cover ensures a locked position of the lever and bolt 45, the lever and bolt being connected by a link.

Referring now to the fully automated trafficway barrier as it is shown in FIGS. 1, 2 and 11 of the drawings, the manual lever is replaced by a power means such as a solenoid 50 responsive to a power supply 51 through control means 52. As shown, there is a sensor loop 53 in the trafficway remote from the bollard installation. The loop 53 is sensitive to the mass of a vehicle or the like passing thereover, and is in circuit with the control means 52 in the form of a responsive circuit means such as those known in this art, to activate the solenoid momentarily for release of the bolt 45 from stop opening 46, whereupon the bollard B is lifted as hereinabove described and automatically latched and/or locked by the bolt 45 re-entering the stop opening 47. The control means 52 includes reset means 54 for subsequent response to the mass sensitive loop 53.

From the foregoing it will be understood that I have provided a manually depressible spring loaded trafficway barrier, wherein potential energy is made instantaneously available for release into kinetic energy that carries the bollard into a raised position where is it automatically locked. Operation can be entirely manual, release can be remote, and release can be electronically controlled by means of a loop sensor system as is disclosed. The bollard structure is reinforced so that it is rugged, and in the event of damage the bollard B can be removed and replaced, as next described.

In accordance with this invention, vehicle retainment means is provided in the bollard B configuration, there being a lip 55 at the perimeter of the top 38 thereof. The lip 55 is in the form of a flange that overlies the wall 30 of the bollard, the flange projecting sufficiently to imbed itself into deforming vehicle parts upon severe impact. Consequently, the imbedded vehicle parts anchor themselves to the bollard configuration characterized by the lip 55. When the bollard B is retracted, the lip 55 lies contiguous to the mounting flange 11.

Assembly and disassembly of the bollard B with respect to the foundation F is provided for. The cylindrical foundation F and spring S are practically indestructable, although it is conceivable that damage can result thereto from a strenuous impact. Also, the bollard B is substantially indestructable, but on occasion might become damaged by deformation impairing its smooth operation. Accordingly, the top plate or flange 11 is removeable by the release of fasteners at 57, to expose the annulus within the cylindrical foundation F and to expose at least one and preferably a pair of retractile retainer means 58. The retainer means 58 are shown as a sleeve threaded into a fixed screw 59, and entering through the foundation wall 10 to engage (releasably) a stop shoulder on the bollard B. The sleeve has a polygonal head accessible in a protective box for operation with a suitable tool.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. A manually depressible spring balanced bollard type trafficway barrier for arresting vehicles, and including;

a below grade level foundation of substantial depth, having a grade level opening at its upper end and having a bottom support, a spring lift means centered upon the bottom support and supporting a bollard in a position of balanced equilibrium between a depressed position and an extended position, the bollard being of tube form entered through the foundation grade level opening and centered over and carried by the spring lift means in said balanced condition extending upward from the grade level, and releasable lock means carried by the foundation and engaged with spaced stops on the bollard, one stop engageable to hold when the bollard is depressed to grade level and the other stop engageable to hold the bollard when extended by the lift means, whereby the spring lift means stores potential energy by depression of the bollard to grade level and subsequently released for transfer into kinetic energy and assisted by inertia to lift the bollard above the position of balanced equilibrium and to the other stop.

2. The trafficway barrier as set forth in claim 1, wherein the bollard of tube form has impact resistant reinforcement means therein, there being a first guide means for rotatable orientation of said reinforcement means with respect to direction of vehicular traffic to absorb impact.

3. The trafficway barrier as set forth in claim 2, wherein the first guide means extends vertically between the foundation and the bollard for rotatable orientation of the bollard.

4. The trafficway barrier as set forth in claim 2, wherein the reinforcement means is comprised of vertically disposed tube walls and at least one vertical web disposed in a plane parallel to the direction of vehicular traffic.

5. The trafficway barrier as set forth in claim 2, wherein the foundation is of tube form surrounding the bollard of tube form, there being a second guide means for coaxial movement of the bollard within the foundation.

6. The trafficway barrier as set forth in claim 5, wherein the second guide means is comprised of runners operating in an annulus between the foundation and the bollard.

7. The trafficway barrier as set forth in claim 5, wherein the second guide means is comprised of runners carried by the bollard and slideable in the foundation of tube form.

8. The trafficway barrier as set forth in claim 2, wherein the reinforcement means is comprised of vertically disposed tube walls and at least one vertical web disposed in a plane parallel to the direction of vehicular traffic, and wherein the second guide means is comprised of runners carried by the bollard in alignment with said web and slideable in the foundation of tube form.

9. The trafficway barrier as set forth in claim 1, wherein the spring lift means is a coil compression spring disposed concentrically within the bollard and seated at its bottom and top ends on the bottom support of the foundation and on a closed top of the bollard.

10. The trafficway barrier as set forth in claim 9, wherein guide means extends centrally within the coil compression spring.

11. The trafficway barrier as set forth in claim 9, wherein guide means comprised of telescoping members supported by the foundation and anchored to the bollard extends centrally within the coil compression spring.

12. The trafficway barrier as set forth in claim 1, wherein the bollard of tube form has impact resistant reinforcement means therein, there being a first guide means for rotatable orientation of said reinforcement means with respect to direction of vehicular traffic to absorb impact, wherein the foundation is of tube form surrounding the bollard of tube form, there being a second guide means for coaxial movement of the bollard within the foundation, wherein the spring lift means is a coil compression spring disposed concentrically within the bollard and seated at its bottom and top ends on the bottom support of the foundation and on a closed top of the bollard, and wherein third guide means extends centrally within the coil compression spring.

13. The trafficway barrier as set forth in claim 1, wherein the bollard of tube form has impact resistant reinforcement means therein, there being a first guide means for rotatable orientation of said reinforcement means with respect to direction of vehicular traffic to absorb impact, wherein the foundation is of tube form surrounding the bollard of tube form, there being a second guide means for coaxial movement of the bollard within the foundation, wherein the spring lift means is a coil compression spring disposed concentrically within the bollard and seated at its bottom and top ends on the bottom support of the foundation and on a closed top of the bollard, and wherein third guide means comprised of a telescoping member supported by the foundation and anchored to the bollard extends centrally within the coil compression spring.

14. The trafficway barrier as set forth in claim 1, wherein the spring lift means is comprised of a spring that is less than fully extended when supporting the weight of the bollard and in equilibrium when the bollard is released from its stops.

15. The trafficway barrier as set forth in claim 1, wherein the lock means is a manually operable bolt housed is a grade level box and accessible for manual operation.

16. The trafficway barrier as set forth in claim 1, wherein the lock means is a remotely operable bolt housed in a box of the foundation for manual operation.

17. The trafficway barrier as set forth in claim 1, wherein the lock means is a power operable bolt housed in a box of the foundation for remote operation.

18. The trafficway barrier as set forth in claim 1, wherein the lock means is a power operable bolt released automatically by control means responsive to a mass sensitive loop placed in the trafficway.

* * * * *